United States Patent [19]

Hauk et al.

[11] 4,090,914

[45] May 23, 1978

[54] APPARATUS FOR APPLYING TAPE AND ADHESIVE TO WALLBOARD JOINTS

[75] Inventors: Thomas D. Hauk, Long Beach; Masato Howard Konishi, Sun Valley, both of Calif.

[73] Assignee: Service Equipment Design Co., Inc., Signal Hill, Calif.

[21] Appl. No.: 784,243

[22] Filed: Apr. 4, 1977

[51] Int. Cl.[2] ..... B32B 31/00; B44C 7/00; B05C 11/02

[52] U.S. Cl. ..... 156/523; 156/575; 118/108; 401/48

[58] Field of Search ..... 156/574, 575, 577, 578, 156/579, 523; 118/108, 207, 305; 401/48, 176, 182

[56] References Cited

U.S. PATENT DOCUMENTS

| | | | |
|---|---|---|---|
| 1,745,802 | 2/1930 | McBurney | 156/575 |
| 2,323,963 | 7/1943 | Ames | 156/575 |
| 2,502,499 | 4/1950 | Ames | 156/575 |
| 2,815,142 | 12/1957 | Ames | 216/25 |
| 2,824,326 | 2/1958 | Ames | 15/132.5 |
| 2,862,382 | 12/1958 | Ames | 72/130 |
| 3,006,495 | 10/1961 | Miller | 156/526 |
| 3,007,837 | 11/1961 | Goode, Jr. | 156/461 |
| 3,070,827 | 1/1963 | Ames | 15/555 |
| 3,116,195 | 12/1963 | Lathrop et al. | 156/575 |
| 3,188,262 | 6/1965 | Torrison | 156/575 |
| 3,260,638 | 7/1966 | Hoveland | 156/575 |
| 3,297,510 | 1/1967 | Broff | 156/357 |
| 3,404,060 | 10/1968 | Taylor, Jr. | 156/526 |
| 3,575,771 | 4/1971 | Padgett | 156/523 |
| 3,598,683 | 8/1971 | Butler et al. | 156/527 |
| 3,625,798 | 12/1971 | Ihli | 156/523 |
| 3,707,427 | 12/1972 | Erickson | 156/575 |
| 3,785,535 | 1/1974 | Ames | 222/331 |
| 3,880,701 | 4/1975 | Moree | 156/526 |
| 3,960,643 | 6/1976 | Dargitz | 156/390 |

*Primary Examiner*—Douglas J. Drummond
*Attorney, Agent, or Firm*—Richard L. Gausewitz

[57] ABSTRACT

A joint-taping tool for wallboard (drywall), wherein there is almost no possibility that the cable will break after the piston reaches the top of its stroke, and wherein the operator is immediately and unquestionably informed when adhesive flow ceases. Furthermore, mechanism is provided by which—with minimized action on the part of the operator—the rollers are prevented from spinning and "throwing" adhesive (cement) during filling of the barrel.

The tool will not only apply tape and adhesive simultaneously, but is rapidly convertible to deposit adhesive over previously-applied tape. This same conversion spacing option makes it possible to eliminate tape jams quickly and easily. In addition, means are provided for thoroughly cleaning the tool at the end of each day.

39 Claims, 16 Drawing Figures

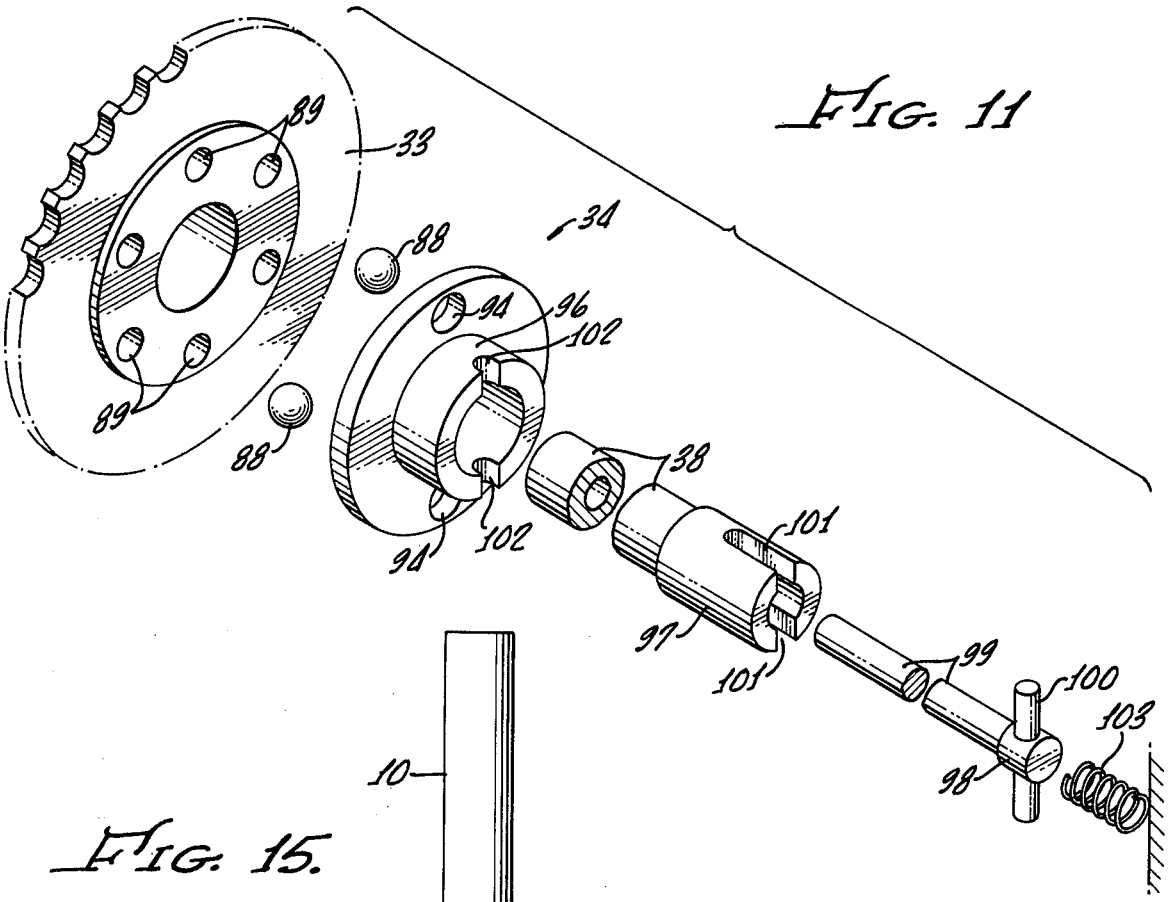
FIG. 11
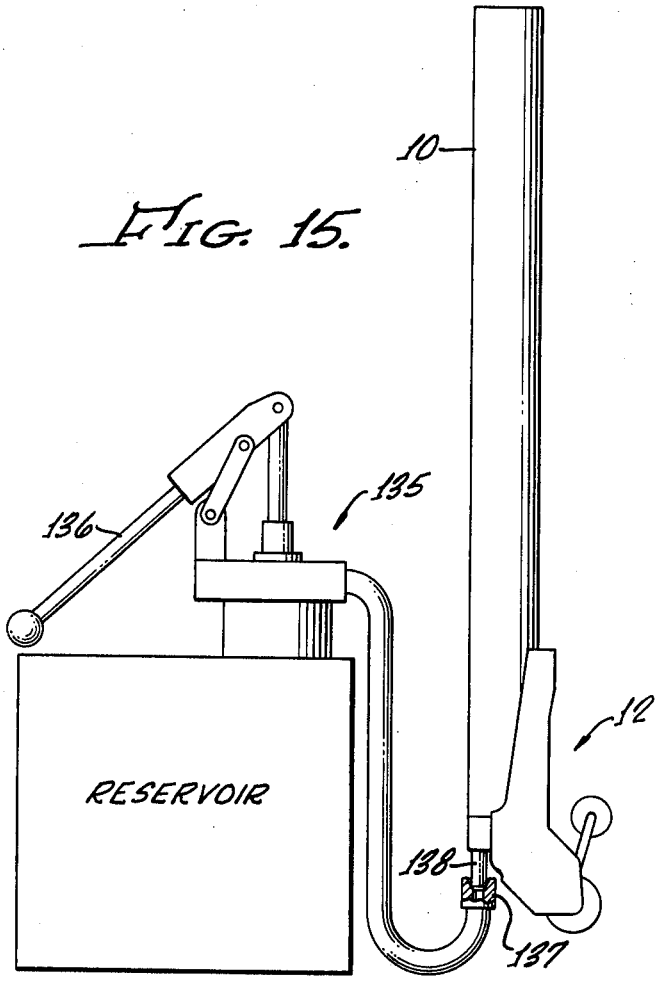
FIG. 15.
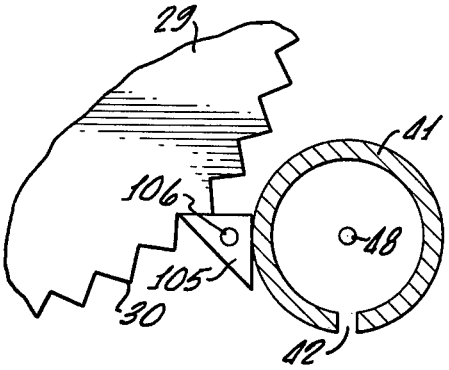
FIG. 12.
FIG. 16.
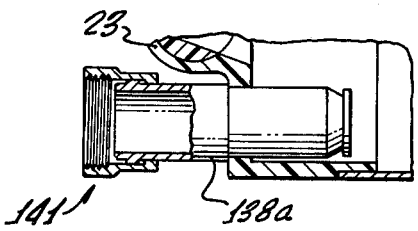

APPARATUS FOR APPLYING TAPE AND ADHESIVE TO WALLBOARD JOINTS

BACKGROUND OF THE INVENTION

1. Field of the Invention

This invention relates to the field of apparatus for applying joint tape and adhesive over the joints between wallboard sections.

2. Description of Prior Art

In what is believed to be the only automatic wallboard joint taper presently employed on a large scale, traction wheels (drive rollers) which roll along the wallboard are used to drive a drum on which a cable is wound. The cable is attached to a piston in the cylinder or reservoir wherein the adhesive (called cement or "mud") is stored. When the piston is at the top of its stroke it can move no further. Thus, flow of adhesive rapidly ceases. When this happens, it is a natural human tendency for the operator to push harder on the traction wheels-the thought being that more adhesive will then flow. Instead, however, what can happen (in the event of malfunction of the below-described release mechanism) is that the cable breaks. In such event, there results a time-consuming disassembly and repair job.

Even when the cable doesn't break, it is highly undesirable for the piston to fully reach the top of its stroke without being at least partially disconnected. This is because the traction wheels are then suddenly braked, causing a jerking stop and possible dislodgment of the already-applied tape.

During approximately the past ten or twenty years, at least two approaches have been made toward solving the stated problems. One proposed solution—the one presently in widespread commercial use on the above-mentioned automatic joint taper—is to provide a pin element disposed to be engaged by the piston and to operate a lever mechanism adapted to fully release the drive to the cable drum as the piston reaches the top region of its stroke. After the drive is thus fully released or disengaged, automatically, the operator uses his thumb to push on a disc to thus shift a second pin (connected to the disc) which is coaxial with the drum. Such second pin maintains the drive released, despite the presence of a return spring bias, so long as the second pin remains thus shifted. To maintain the second pin thus shifted, and to simultaneously close a valve which prevents discharge of adhesive during reservoir filling, the operator pivots the valve handle over the indicated disc. Stated otherwise, the valve-closing element performs the second function of maintaining the disc and second pin shifted (so that the cable drum drive stays disengaged). Because the drum drive stays disengaged, there is no throwing of adhesive during reservoir filling.

The described drive-release mechanism is disadvantageous in several respects, which are here stated but not necessarily in order of importance. Firstly, it uses exposed, external lever and other elements which may become broken, gummed-up or otherwise disabled. When this occurs, the cable may break and the tool may come to a jerking stop—with attendant harmful results as described above. Secondly, the described release mechanism uses a pin which extends inwardly through the end wall of the cylinder and thus is exposed to adhesive, creating problems of operation and maintenance. Thirdly, the operator often does not hear the noise made by the release mechanism and therefore is not cognizant of the fact that stroke-end has been reached, so he goes on taping (for a short period) in the absence of any adhesive to secure the tape to the wallboard. Fourthly, the means for maintaining the mechanism released requires that the thumb and at least one other finger of the operator be used immediately prior to the filling operation described below (one digit being needed to press on the disc, another to pivot the valve handle). Fifthly, denting of the thin-walled barrel may cause the piston to jam long before it reaches the end of its stroke, with resultant probability of cable breakage.

A second approach toward solution of the problems of preventing cable breakage, and preventing tool jerking when the piston reaches the top of its stroke, is simple but impractical. This is to make the cylinder of transparent material so that the operator can watch and see the position of the piston. However, the operator is normally watching the joint, not the cylinder, and either cannot or will not—in a sufficently high percentage of cases—discern when the stroke-top is being closely approached.

Referring next to the filling of the reservoir with adhesive, this is necessarily accompanied by release of the cable-drum drive or at least two bad results occur. The traction wheels (drive rollers), sprockets and chain are often covered with adhesive and if allowed to spin rapidly—as the result of pushing of the piston to the bottom of its stroke while the reservoir chamber is filled—would cause adhesive to be thrown centrifugally onto the floor and walls. Secondly, connection of the wheels and sprockets during filling would increase the resistance to injection of adhesive into the reservoir. Thirdly, rapidly spinning sprockets and toothed traction wheels would create an accident hazard.

As above stated, the above-indicated prior-art automatic taper does maintain drive disengagement during filling, but does so in an awkward manner requiring not only large external elements but also the use (immediately before commencement of filling) of at least two digits of the operator.

Proceeding next to other major characteristics of prior-art joint tapers, it is emphasized that (a) the tape must be cut at the end of each joint, and (b) such cutting must occur after tape-feeding stops. If, as happens occasionally even with highly experienced operators, the cutting operation is attempted while the tool is still moving, the tool will usually jam. Jamming occurs because the moving (still being fed) tape bunches up against the side of the cutting blade.

In the above-described joint-taping apparatus now used commercially to a large extent, such jamming often results in a substantial delay. This is because the cutting blade is relatively inaccessible, being only reachable after a time-consuming disassembly operation. Thus, it is important that the jammed cutting blade and adjacent regions be rendered accessible in a matter of seconds. Applicants have accomplished this, and have simultaneously solved a second problem present in prior-art joint tapers.

This second problem is that of applying only adhesive or "mud" (not tape) over a strip of tape already present on a joint. It is common to first cause a tape strip to adhere over a joint, by means of adhesive, then to let the adhesive dry, then to apply a second layer of adhesive, and then to "work" such second layer so that it blends into the wall. Previously, insofar as applicants are aware, such second layer has been applied (1) manually, or (2) by an automatic tool entirely separate from that used for first laying of the tape, or (3) by a special "follower" portion of a tape-laying tool. Manual operation, with only a knife, etc., has obvious disadvantages in regard to such factors as speed. The use of a separate tool requires additional costs, storage room, etc. The immediate laying of a second layer over the tape, before the first layer has dried, greatly increases the overall drying time. For this reason, and because the special follower portion is heavy and awkward to use, the third of the specified alternatives is also not satisfactory.

SUMMARY OF THE INVENTION

Applicants have reduced to virtually zero the chances of cable breakage, and sudden jerking stops of the tool, as the piston reaches the top of its stroke. This is done not by effecting disengagement at that time, or by relying upon any visual inspection expedient. Applicants don't try to stop the piston from reaching the top, instead letting this happen. However, when it does happen it is absolutely harmless because there is a torque limiter, of predetermined precision construction, interposed between the traction wheels (drive roller means) and the piston. The torque limiter is so set that there is enough torque to feed the adhesive (mud), but not enough torque to either break the cable or cause jerky stopping. When the piston hits the top, the cable being fully wound, the torque limiter generates a sound that instantly informs the operator of the cessation of mud feed. Thus, taping is immediately stopped. The torque limiter being of precision construction, and being fully housed, protected and lubricated (not ever being contacted by the adhesive) there is almost no chance that it will malfunction.

In combination with the torque limiter, and preferably in the same housing, applicants provide a means to achieve disengagement of the drive. Such means is operated by a single camming crank which can be shifted by only one finger or thumb of the operator. The camming crank closes the valve which permits refilling to occur and, in addition, disengages the drive to the drum. Such disengagement is maintained until the crank is again shifted after cessation of the filling operation. The drive thus being disengaged, there is no throwing of mud or possibility of injury due to free wheeling of the traction wheels. To absolutely prevent such free wheeling, despite the possible effects of any residual friction in the system, pawl means (known per se in prior-art tapers) are provided to prevent the traction wheels from reverse-rotating at any time.

In order to solve the described problems relative to (1) achieving access to a jammed region at the cutting blade and (2) permitting the same tool to effect post-application of adhesive over a tape, applicants provide quick-connect nozzle elements the joints for which are adjacent the cutting blade area. To reach a jammed blade region, the "standard" nozzle (used during initial taping) is readily disconnected. The cutting region being thus exposed, the jam is eliminated and the nozzle remounted. When mud is to be deposited over a previously applied dry tape, a special "post-deposit" nozzle is provided in place of the standard one. This nozzle feeds mud directly to the dry tape on the wallboard, yet permits the same traction and roller assembly to be used as when the standard nozzle is present. The post-deposit nozzle is located to close to the traction wheels that the tool is readily manipulated to various angular positions.

The nozzles and associated body parts are preferably injection molded of synthetic resin. The body contains a "globe" valve characterized by the ability to completely prevent the escape of adhesive during the refilling operation—this being in contrast to mere flapper valves provided in the nozzles of prior-art automatic tapers.

An additional element, which simplifies substantially the clean-up operation at the end of each working day, comprises a female hose fitting around the port which connects to the adhesive pump. Thus, water is easily flowed through the check valve and through the reservoir and nozzle for removal of residual adhesive.

BRIEF DESCRIPTION OF THE DRAWINGS

FIG. 11 is an exploded view of the combination torque limiter and drive-disengager;

FIG. 12 is an enlarged schematic view of the pawl and "ratchet";

FIG. 15 represents schematically the fill pump and the filling operation; and FIG. 16 illustrates the embodiment wherein there is a water cleanout fitting.

GENERAL DESCRIPTION OF THE TOOL

The present tool constitutes a major improvement over the one shown in Ames U.S. Pat. No. 2,815,142 and over the present production version of such Ames tool. The present production version incorporates some of the structure disclosed in Ames Pat. No. 2,862,382, but changed as described in the present application under the subheading "Description of Prior Art".

Figure 1:
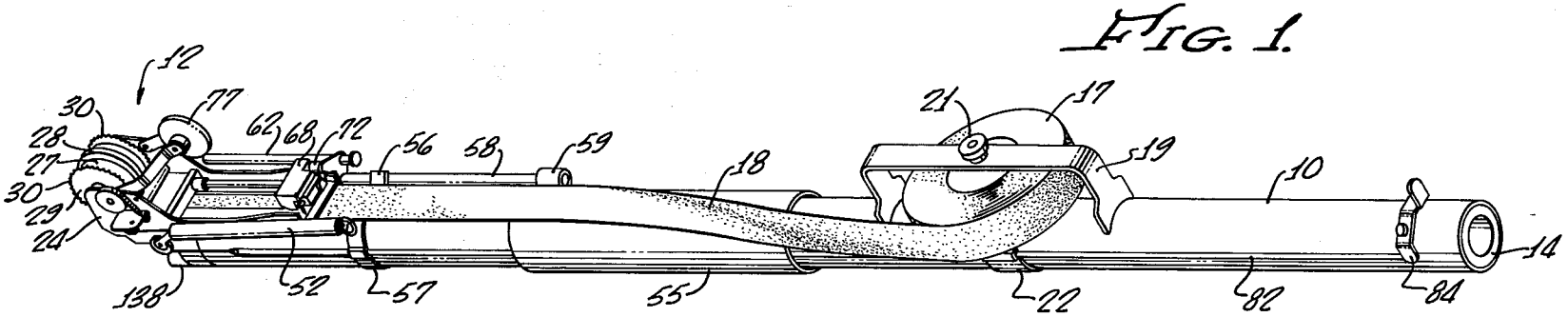
FIG. 1 is an isometric view of the entire tool.
Figure 5:
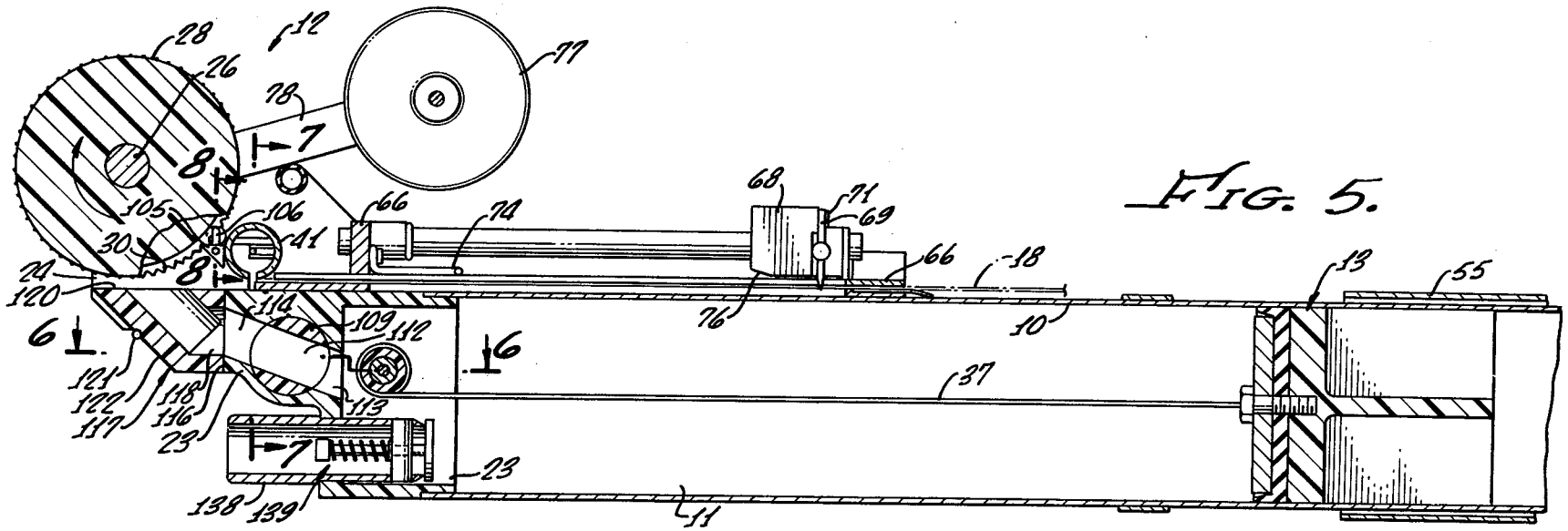
FIG. 5 is a longitudinal sectional view taken on line 5—5 of FIG. 4.

Referring first to FIG. 1, there is shown a long hollow barrel 10, formed of aluminum or other lightweight material, and which constitutes the cylinder defining the reservoir chamber 11 for adhesive (mud). The chamber 11 is best shown in FIG. 5, being defined at its inner end by the head 12 of the apparatus, and at its outer end by the piston 13 which moves within the cylinder or barrel 10. At the extreme outer end of barrel 10 is a stop ring 14 (right end of FIG. 1) adapted to prevent excessive outward movement of piston 13 during refilling of chamber 11.

The right end of the tool, as viewed in FIG. 1, is called the "outer" end because this is remote from the joint being taped. Conversely, head 12 is at the "inner" end of the tool (left end of FIG. 1), this being the working end of the tool which is directly adjacent the joint. It is to be understood that the joint is a conventional butt joint between two adjacent sections of wallboard or drywall, one of such sections being indicated at 16 in FIG. 13.

A roll 17 of conventional joint tape 18 is shown in FIG. 1 as being freely rotatably mounted in a removable tape guard 19 on barrel 10. The tape guard 19 is readily removed, by first removing a hand-operated screw 21 which is threaded into a shaft (not shown) for the hub of roll 17. Such shaft, is, in turn, mounted on barrel 10 as by means of clamping bands 22. To replace roll 17, the screw 21 is manually removed, following which the entire tape guard 19 is removed so that a new tape roll may be mounted in position as shown.

The tape 18, after it leaves roll 17, extends freely up the side of barrel 10 until it reaches head 12. As shown at the left end of FIG. 5, head 12 contains or mounts most of the moving parts of the apparatus. It comprises an injection-molded plastic body 23 the right end (FIG. 5) of which is necked down slightly so as to telescope within the left end of barrel 10. Suitable mounting screws, not shown, are provided to connect the head and barrel ends for rigid mounting of the head in a manner which permits rapid removal when desired.

Figure 2:
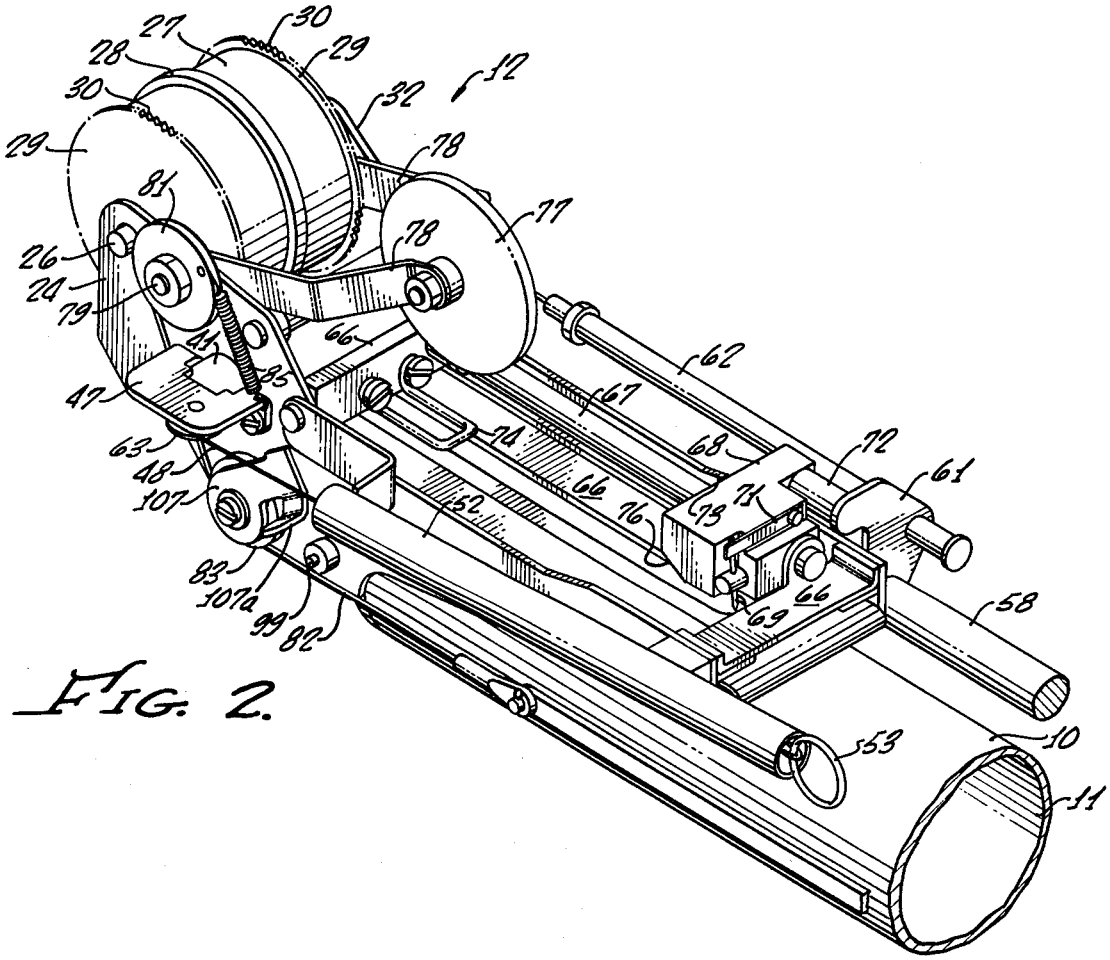
FIG. 2 is an enlarged isometric view showing only the back (trailing) side of the head end of the tool.
Figure 3:
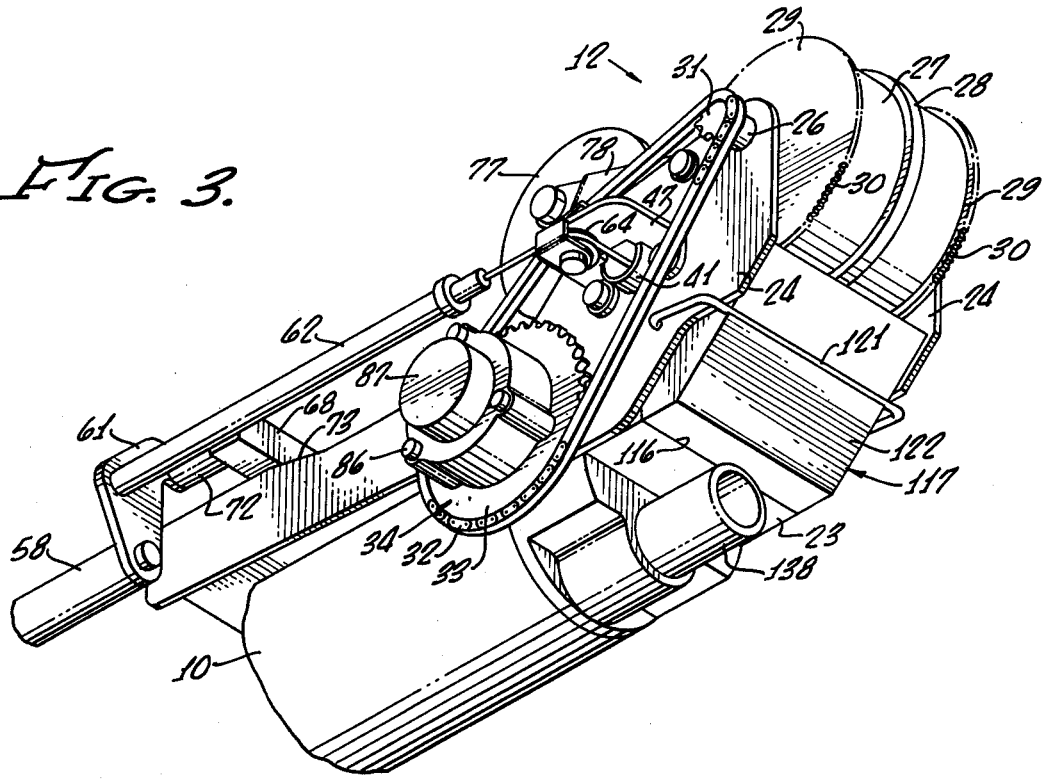
FIG. 3 is another enlarged isometric view showing the front (forward) side of the head end, illustrating in operating position the standard-connect nozzle.

Head 12 further comprises, a basic supporting and guide elements, two side plates 24 which correspond substantially to each other and are mounted parallel to each other on opposite sides of body 23. The mounting of the side plates to the head body is effected by suitable longitudinal screws which extend through suitable ears on the side plates and into the head body. Side plates 24 have, as shown in FIGS. 2 and 3, outer portions which extend away from the end of barrel 10. They also have inner elongated (arm) portions which extend along the sides of the barrel and are associated with tape feed means described below.

The outer portions of side plates 24 have extended therethrough a shaft 26 for a roller and wheel assembly. Such assembly comprises an injection-molded plastic (synthetic resin) roller 27 having a central flange 28 adapted to support the central region of joint tape 18. Immediately adjacent each side of roller 27 is a metal traction wheel or drive roller 29 the periphery of which is provided with teeth 30. The teeth increase the traction with the wallboard, and further cooperate with paul means (described below) to prevent reverse rotation of the elements 27, 29.

The traction wheels or drive rollers 29 are rigidly affixed to shaft 26 so that, when the wheels 29 roll against the wallboard, shaft 26 is positively driven to thus rotate a sprocket 31 (FIGS. 3 and 9) at its end. Such sprocket is meshed with a chain 32 which extends around a much larger sprocket 33 on the torque-limiter and drive-disengager device 34 described in detail subsequently.

Figure 6:
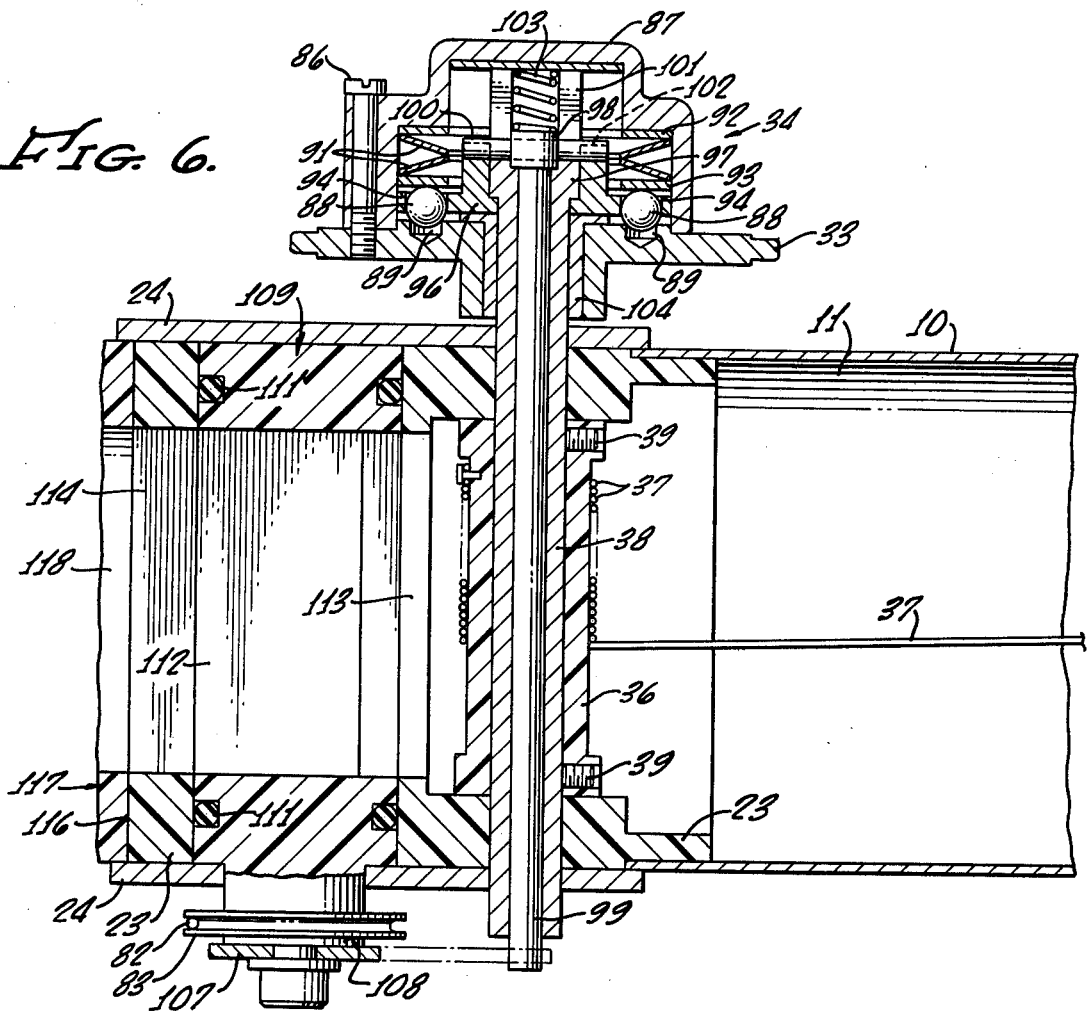
FIG. 6 is a greatly enlarged fragmentary longitudinal section on line 6—6 of FIG. 5, showing the torque limiter, drive disengager and the shutoff valve.

The inner portion of the head body 23 is hollow, as shown in FIGS. 5 and 6, to receive the drum 36 for the cable 37 which extends through reservoir chamber 11 to piston 13. As shown in FIG. 6, such drum is locked to a coaxial hollow shaft 38 by means of set screws 39. Such shaft 38 extends not only through the side walls of body 23 but also through side plates 24.

One end of shaft 38 is connected through the torque limiter 34 to the chain 32. Thus, and because of the relative sizes of sprockets 31 and 33, rolling of traction wheels 29 along the wallboard (in straddling relationship to the wallboard joint) causes a much slower shifting of piston 13 toward the upper end of its stroke (namely, toward head 12). Adhesive, not shown, is thus forced out of reservoir chamber 11 and applied to the interior surface of tape 18 as described hereinafter. The rate of feeding of the adhesive is proportional to the rate of dispensing of the tape.

DESCRIPTION OF THE CUTOFF MEANS, THE TAPE-PUSHING MEANS, AND THE CORNER ROLLER

The apparatus described under this subheading are not per se basically new, being instead improved designs of prior-art structure.

Figure 7:
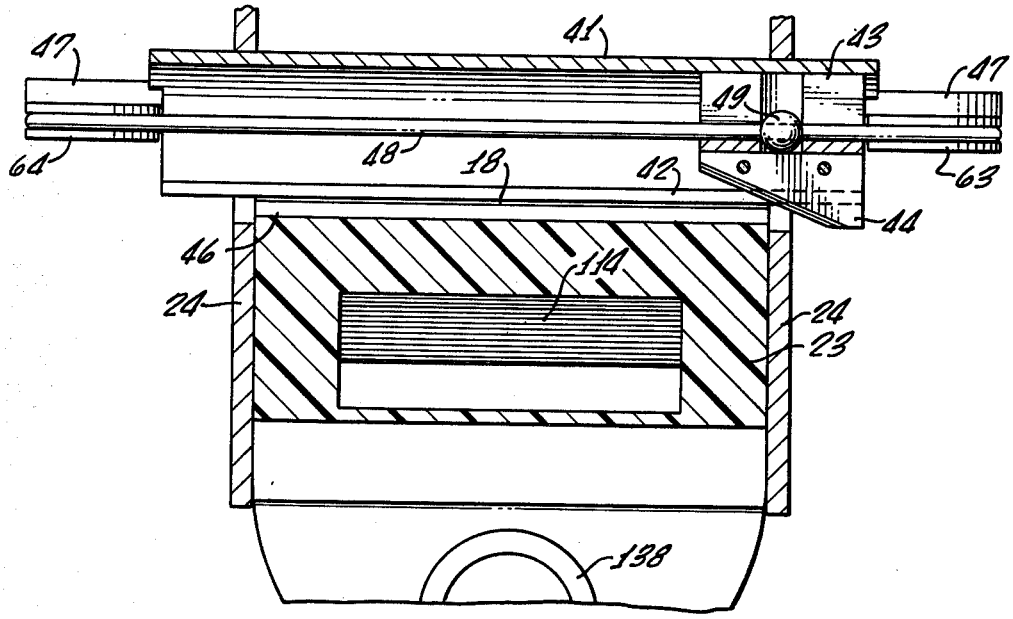
FIG. 7 is a sectional view taken on line 7—7 of FIG. 5, showing the cutoff knife and also the mud passage.
Figure 10:
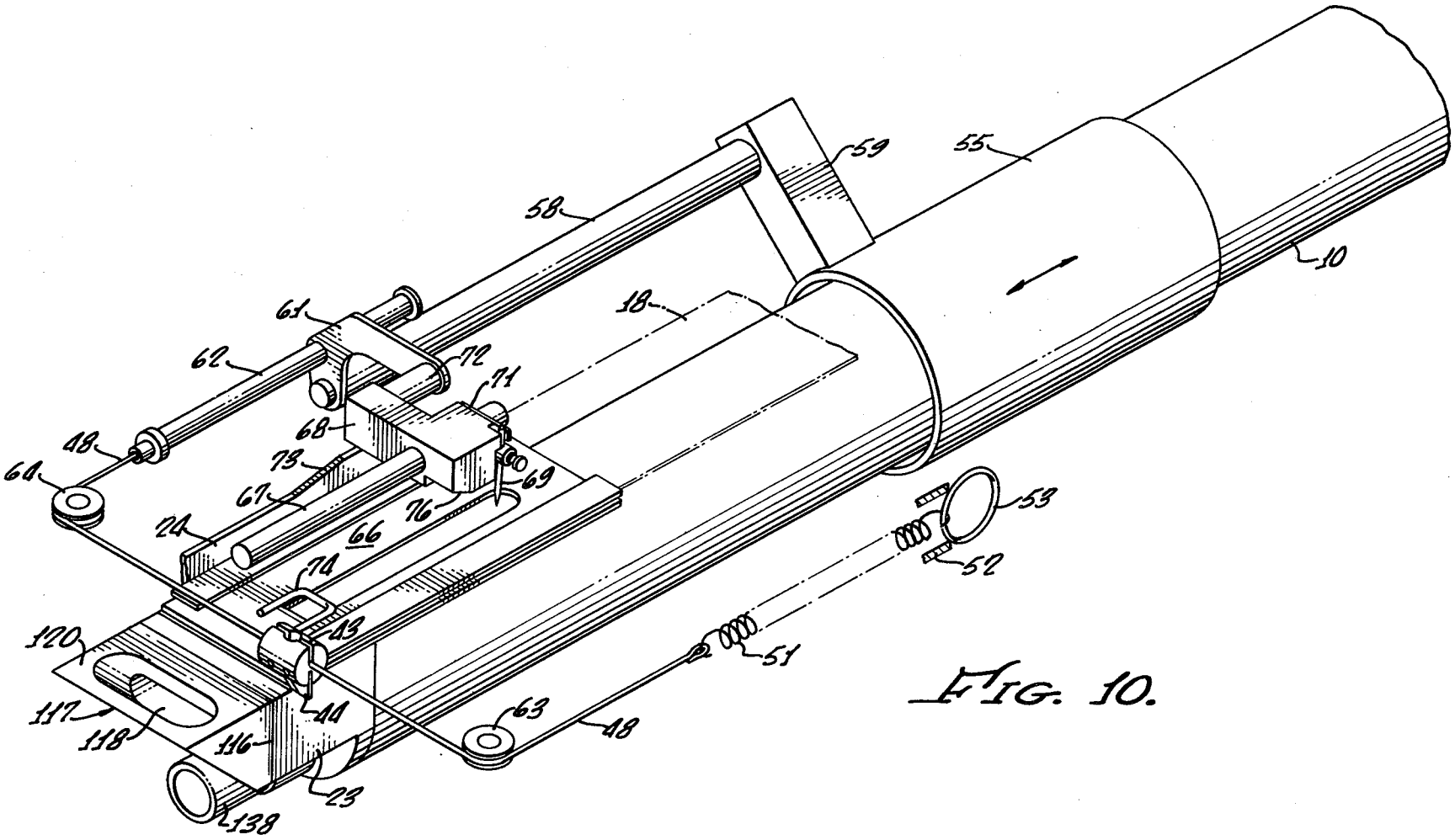
FIG. 10 is a schematic view of the cutoff, nozzle and tape-feed system.

Referring to FIGS. 5, 7 and 10, there is extended through opposed openings in side plates 24 a cylindrical tube 41 having a longitudinal slit 42 along the full length thereof. A "piston" 43 carrying a slanted knife blade 44 is mounted slidably in tube 41, in such relationship that the blade 44 is in slit 42. The blade extends sufficiently far out of the tube as to cross a passage 46 (FIG. 7) through which tape 18 passes on its way to the roller 27.

Each end of tube 41 is held against longitudinal and rotational shifting by means of a U-shaped bracket 47 (FIGS. 2 and 3) which, in turn, is secured by screws to the adjacent side plate 24. For prevention of rotation, the tube ends are notched and receive therein inner portions of the bases of the U-brackets. A cable 48 extends longitudinally through tube 41 and through piston 43, being disposed in a transverse slot in the latter and held therein by a bail 49 (FIG. 7) on the cable.

Cable 48 is normally spring-biased to such position that knife blade 44 is fully retracted, and is not in blocking relationship to the tape passage 46. Such retraction is effected by an elongated tension spring 51 (FIG. 10) which is contained in a tube 52 (FIG. 2). The end of the spring has a ring 53 thereon so as to prevent its passage through tube 52. Tube 52 is fixedly mounted, by suitable brackets 54, on a side plate 24.

Figure 4:
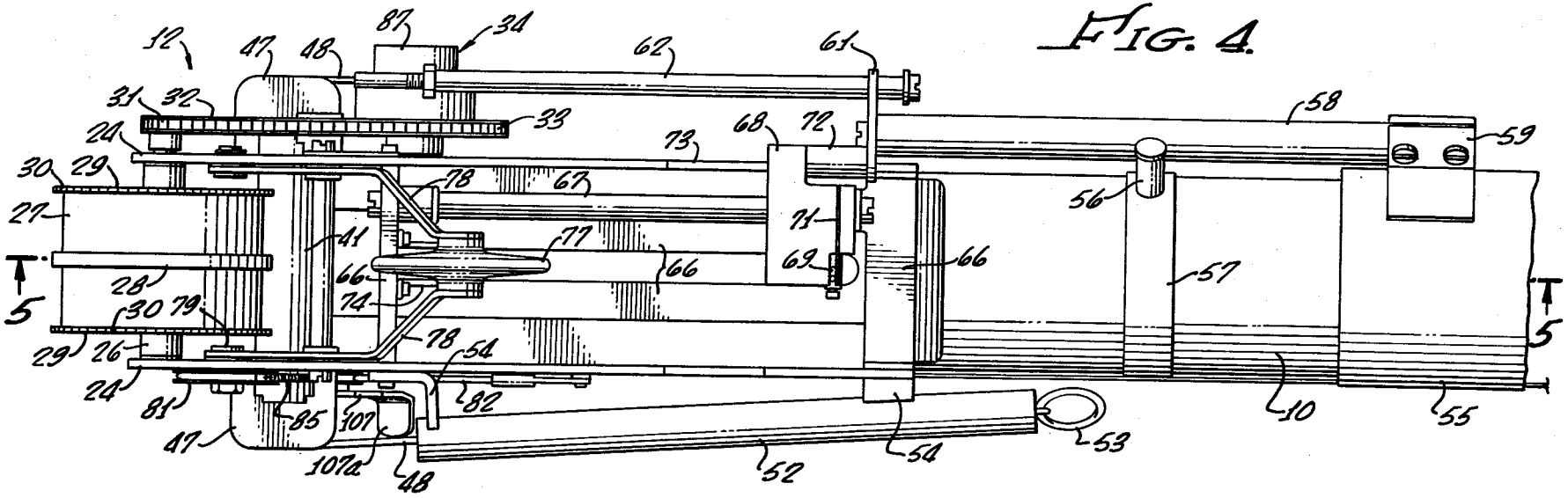
FIG. 4 is a plan view of the trailing side of the head end.

An actuating sleeve 55 is mounted coaxially around the central region of barrel 10 in longitudinally-slidable but nonrotatable relationship. Rotation is prevented by a pair of ears 56 (FIG. 4) which project radially from a strap 57 secured to barrel 10, being disposed on opposite sides of a longitudinal tube 58. One end of tube 58, the outer end (right as viewed in FIG. 4), is secured to sleeve 55 by means of a bracket 59, whereas the other tube end is secured by a screw to a transverse steel plate 61. Such plate is, in turn, connected to a second longitudinal tube 62 which is suitably adjustbly secured to the end of cable 48. Pulleys 63, 64 (FIGS. 2 and 3) are rotatably mounted on U-brackets 47 and have the cable 48 extended therearound.

To achieve cutoff of the joint tape 18 after the end of a joint is reached, the operator shifts sleeve 55 in a direction away from head 12 to thereby pull on cable 48 (against the bias of spring 51) until piston 43 and blade 44 have traversed the tape passage 46 (see FIGS. 10 and 7). The return spring 51 then pulls the piston and blade back to the retracted position shown in FIG. 7.

After the described cutoff, the tape end is no longer adjacent the wall (in the vicinity of roller means 27–30) but instead is adjacent the tube 41 and blade 44. Thus, feed means must be provided to feed the tape until its end is again adjacent the rollers and the wallboard joint, to thus condition the tool for commencement of taping of a new joint.

In the present form of such a tape-feeding means, suitable frame means 66 are secured between side plates 24 and define therein a passage (communicating with passage 46, FIG. 7) through which the tape 18 can feed to the vicinity of the knife A guide and pivot rod 67 extends longitudinally of the tool between portions of frame means 66, having mounted slidably thereon an injection-molded synthetic resin block 68 (FIGS. 2 and 10) which carries a needle 69 in pivotable relationship. The needle is biased toward one of its pivoted positions by a flat spring 71 best shown in FIG. 2. The relationships are such that when block 68 is so pivoted about rod 67 that needle 69 penetrates into tape 18, shifting of the block toward the rollers will cause positive feeding of the tape as desired.

Block 68 is not only associated with needle 69 but also has mounted thereon a permanent magnet 72 the end of which interacts with the above-indicated steel plate 61. Magnet 72 is sufficiently strong that, when tube 58 is pulled in a direction away from the head due to corresponding shifting of sleeve 55, the block 68 and needle 69 will be returned back to the position shown in the drawings. The magnet is also sufficiently strong to prevent any pivoting of block 68 about rod 67 except in response to cam means next to be described. However, the magnet 72 is sufficiently weak that the steel plate 61 may readily separate from the magnet during the above-described cutoff operation.

The cam means comprises an inclined region 73 (FIGS. 3 and 10) of a side plate 24, and which cooperates with a portion of block 68. Another cam means comprises a U-shaped bracket 74 (FIGS. 2 and 10) which is secured to the frame means 66 and cooperates with an inclined lower edge portion 76 of block 68.

Thus, when block 68 approaches the end of its feeding stroke toward the rollers, edge portion 76 rides over U-bracket 74 to pivot block 68 about rod 67 until the needle 69 lifts out of the tape. This lifted relationship of the needle continues during return stroke of the block and needle away from the rollers, until the inclined region 73 is engaged to pivot block 68 in the opposite direction, and again cause the needle to penetrate into the tape. The length of the positive feed thus achieved is correlated to the spacing between the knife blade and the rollers, and is such as to cause the tape end to be adjacent the rollers for commencement of taping of a new joint.

Figure 9:
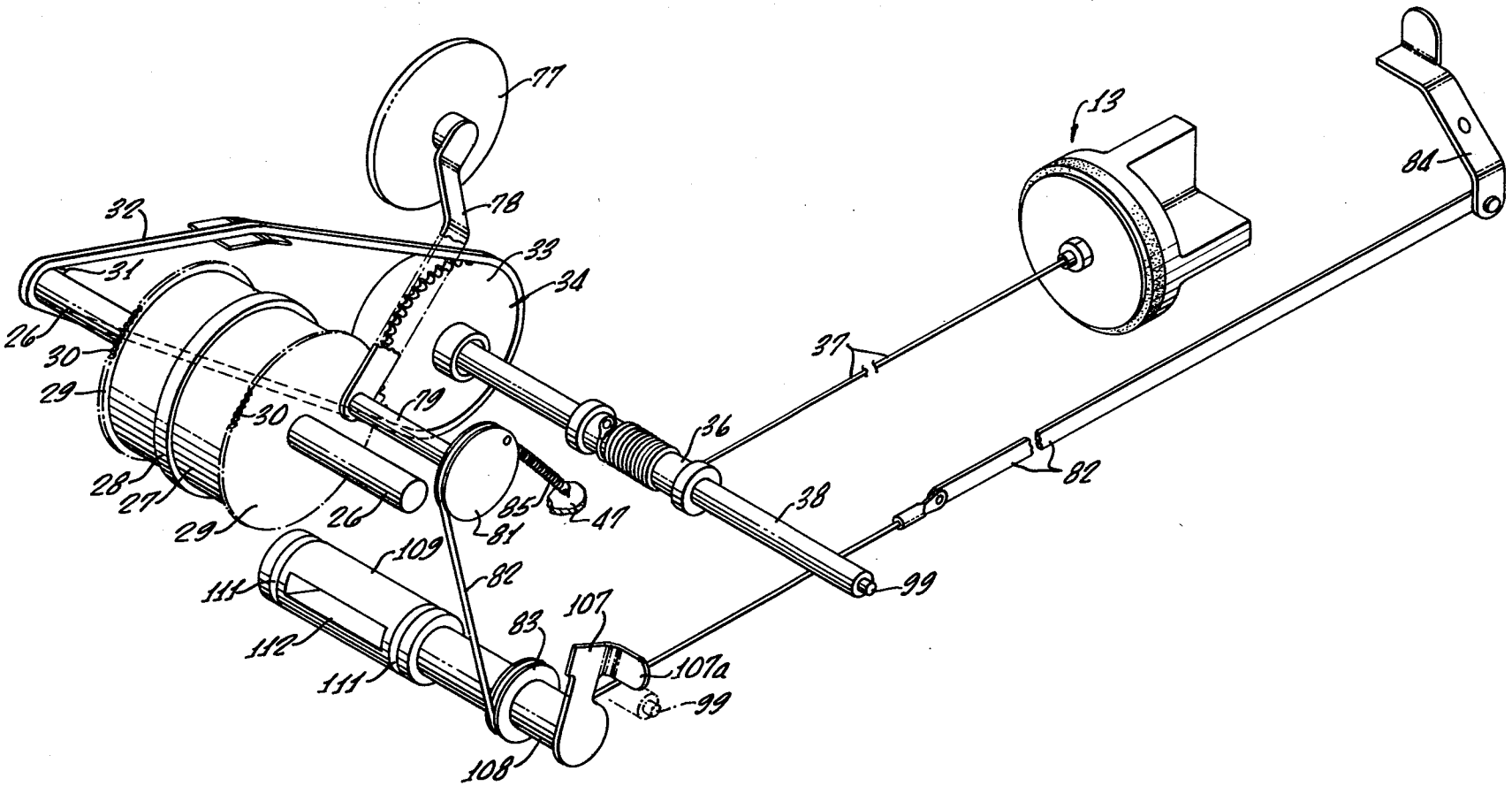
FIG. 9 is a schematic view representing various ones of the moving parts in the tool.

A corner or creasing roller 77 is provided for use during those times when a joint tape is to be placed in a corner (in a joint between wallboard sections at right angles to each other). Roller 77 is mounted on a yoke 78 which is pivoted to side plates 24. As best shown in FIGS. 2 and 9, one side of the yoke is thus pivoted at a shaft 79 having a pulley 81 at its outer end.

A cable 82 is connected at one end to a tension spring 83 and thus to a side plate 24 (at a U-bracket 47). The cable 82 extends around pulley 81 and also around a pulley 83 on a valve shaft 108 to be described subsequently, following which the cable 82 extends almost the full length of the barrel to the end of a lever 84 (FIG. 1) which is pivoted to such barrel. In the illustrated embodiment, the cable is partly highly flexible, and partly a thin aluminum strip-but it is to be understood that the entire cable may be highly flexible.

To shift the corner roller 77 into operative position outwardly of the various roller and wheel elements 27–30, the operator pivots lever 84 to thus pull on cable 82, thereby causing rotation of pulley 81 in a counterclockwise direction (FIG. 2). This operates through yoke 78 to shift roller 77 to operative position. Upon release of the lever 84, the spring 85 returns the roller 77 to its illustrated retracted position.

COMBINATION TORQUE LIMITER, DRIVE DISENGAGER AND VALVE

Referring particularly to FIGS. 6, 9 and 11, there is shown the precision torque limiter and drive disengager 34 which is interposed in the drive from traction wheels 29 to cable drum 36 for piston 13. The large sprocket 33 in the indicated drive is, as shown in FIGS. 3 and 6, secured by screws 86 to a protective housing 87, so that the housing rotates with the sprocket.

As above stated, sprocket 33 is driven at all times when traction wheels (drive rollers) 29 are rotating. However, at no time is there a positive drive to the cable drum 36, the only drive being through balls 88 which extend partially into undersize recesses 89 in the outer face of sprocket 33. Such balls are spring-pressed, into frictional gripping relationship relative to the edge regions around recesses 89, by means of belleville springs 91 (FIG. 6) which are disposed within housing 87 between washer elements 92 and 93 (one such washer seating on a shoulder portion of the housing).

Balls 88 are sufficiently large that less than half thereof are ever disposed in recesses 89. Thus, torque above a predetermined amount will cause the balls to shift out of the recesses—against the spring bias. The exact amount of such disengaging torque may be accurately controlled and regulated, as by using different-strength belleville springs.

The balls 88 are not only spring-pressed toward recesses 89, but are maintained loosely in holes 94 in the flange portion of a hub element 96. Such hub element has a central portion which is mounted rotatably around an enlarged end portion 97 of the above-indicated hollow shaft 38 for drum 36. Enlarged end 97 is, in turn, mounted around the enlarged end 98 of a long actuating pin 99 which extends through the full length of shaft 38 and protrudes outwardly therefrom as shown at the bottom in FIG. 6.

A cross pin 100 is mounted in the enlarged pin end 98 and extends at all times through diametrically-opposed slots 101 in enlarged end 97. When a driving relationship (but limited as to torque) is to be achieved, the pin ends also seat in circumferentially-spaced end recesses 102 in hub element 96. This seating is effected by means of a compression spring 103 which is disposed in end 97 and spring-presses the enlarged end 98 so as to maintain the pin 100 in such recesses 102.

When the various parts are in the position shown in FIG. 6, there is a driving connection between traction wheels 29 and drum 36 provided, however, that the amount of force necessary to shift the piston 13 and thus effect feeding of the adhesive it not much greater than a predetermined amount. Such "predetermined amount" is that necessary to feed the particular adhesive, which is employed in securing the joint tape to the wallboard, through the various passages and ports to the tape 18. Conversely, the drive through the torque limiter 34 is never sufficiently strong to effect either breaking of cable 37, or a sudden jerking stop, when the piston 13 moves all the way to the left (FIGS. 5 and 6) and engages the inner end of head body 23.

The predetermined driving torque thus transmitted through the limiter 34 is determined by the strength of the belleville springs 91, the sizes of balls 88 and recesses 89, etc., and can remain constant so long as the same adhesive is employed. This is for long periods of time since the adhesive is standard in the industry.

It is pointed out that spring 103 is sufficiently strong to maintain cross pin 100 in recesses 102 at all times except when the exposed end of pin 99 is intentionally pressed in as described below. Thus, the torque limiting occurs solely at balls 88.

The housing 87 is filled with grease. Such grease cannot escape, nor can adhesive enter, since a sleeve 104 (FIG. 6) is disposed closely in the hub portion of sprocket 33. The inner end of such sleeve is flanged to provide a desired amount of space between the sprocket and the opposed flange portion of hub element 96.

It is emphasized that the described precision torque-limiter device is impervious to the effects of adhesive, of moisture, etc., and therefore will maintain its predetermined torque-transmitting capability under a wide variety of operating conditions.

When piston 13 engages the end of head body 23, the balls 88 are sequentially cammed out of their respective recesses 89 in sprocket 33 and then permitted to snap back into the next adjacent recesses. Such action continues repetitively as the tool is moved along the wallboard. This produces a repeated, pronounced clicking noise which immediately informs the operator that the adhesive is no longer feeding and that reservoir chamber 11 should be refilled. The operator thus immediately ceases the taping operation and effects refilling of chamber 11. The clicking noise is sufficiently loud and frequently repeated that it definitely informs any person (having normal hearing capability) of the cessation of adhesive flow.

The refilling operation, described below, would be accompanied by rapid spinning of sprockets 33 and 31, as well as wheels or rollers 29, etc., in the absence of the disengagement operation next to be described. Such rapid spinning would be undesirable for various reasons, one of which is that these elements are frequently covered with adhesive and thus would throw such adhesive to various parts of the room. Furthermore, the spinning of these elements increases the resistance to filling of the reservoir, and creates an accident hazard.

To disengage drum 36 (and thus the piston 13) from traction wheels 29, the actuating pin 99 is shifted inwardly, thus causing the cross pin 100 to move out of and be clear of the end slots 102 in hub 96. Therefore, as the piston 13 is forced to the right (as viewed in FIGS. 5 and 6) due to the entrance of adhesive into chamber 11, it pulls on cable 37 to effect spinning of drum 36 and the associated shaft 38 and pins 99, 100. Such spinning, however, does not impart rotation to hub 96 nor to sprocket 33 due to the above-indicated disengagement of the cross pin ends from the hub recesses 102.

Since there is necessarily a small amount of friction present in the system, means are also provided to prevent any reverse rotation of traction wheels 29 at any time. Such "reverse rotation" is that direction opposite to the direction the wheels rotate during application of tape to a joint. Stated otherwise, the reverse rotation is that direction in which the wheels 29 are trying to rotate during refilling of the reservoir, in response to outward shifting of the piston 13.

Figure 8:
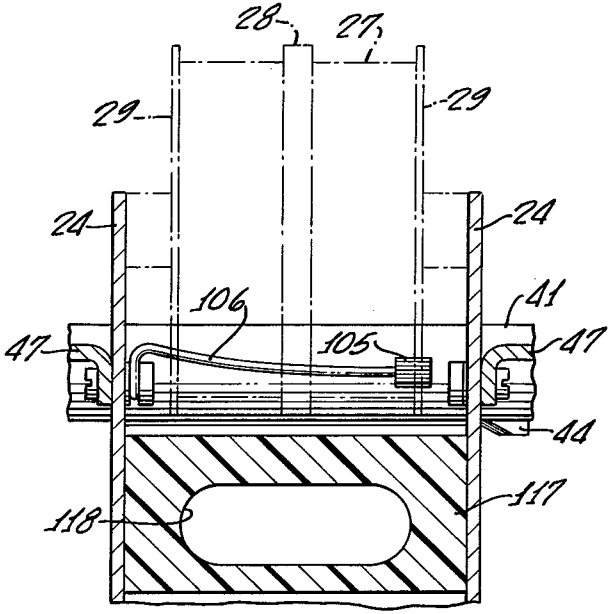
FIG. 8 is an enlarged sectional view on line 8—8 of FIG. 5, illustrating the pawl mechanism.

Referring to FIGS. 12 and 8, prevention of reverse rotation is effected by a pawl in the form of a wedge element 105 one corner of which is spring-pressed between the teeth 30 (FIG. 12) of one of the traction wheels 29. The wedge is connected to a cantilevered spring 106 at the free end of the spring. The other end of the spring is secured to a side plate 24 as indicated in FIG. 8. The pawl wedge 105 permits traction wheel 29 to move only in the forward direction, that is to say clockwise as viewed in FIG. 12, such clockwise rotation being accompanied by shifting of the wedge (against the bias of spring 106) to a position somewhat below that shown in FIG. 12.

When the traction wheels 29 attempt to rotate in the reverse direction, due to the friction in the system as indicated above, wedge 105 binds between the teeth 30 and an outer surface portion of tube 41 of the tape-cutting apparatus. Accordingly, the traction wheels are prevented from rotating in the reverse direction as desired.

The above-indicated inward shifting of actuating pin 99, to disengage the drive through torque limiter and drive disengager 34, is effected by a camming crank 107 (FIGS. 2, 6 and 9) adapted to be easily shifted by only one finger of the operator. When such crank 107 is pivoted clockwise from the position shown in FIG. 2, to a position at which it is adjacent the outer end of pin 99, the outer end of the crank rides over such pin 99 and forces it inwardly to effect the above-described disengagement of cross pin 100 from recesses 102. The drive through torque limiter 34 between the piston and the traction wheels 29 is thus interupted.

In order that the outer end of crank 107 will ride over the outer pin end 99 and depress it as described, such outer crank end is suitably rounded or inclined. Such rounded portion is between the main body of the crank 107 and an outwardly-extending ear portion **107*a* thereof, as shown in FIGS. 2 and 9. The portion 107*a*** is adapted to be engaged by a finger of the operator.

Crank 107 is rigidly secured to the outer end of shaft 108 of a cylindrical "globe" valve 109 which is rotatably mounted in a corresponding cylindrical cavity or recess in head body 23. As shown in FIG. 6, valve 109 is illustrated as being an injection-molded plastic (synthetic resin) element and has O-rings 111 at the ends thereof, to insure against any lateral flow of adhesive.

Element 109 has a slot 112 therethrough, the dimension of such slot transversely of the tool being on the same order of magnitude as the width of tape 18. When valve 109 is in the rotated position shown in FIG. 5, slot 112 registers with correspondingly-shaped passages 113–114 in head body 23. Thus, at such times, adhesive may flow from reservoir chamber 11 through passages 113–114 and slot 112 to nozzle means described below.

When, on the other hand, valve element 109 is rotated approximately 90° to a position at which slot 112 does not register with passages 113–114, there is a positive shutoff of flow as is necessary during filling of reservoir chamber 11. Furthermore, as indicated above, the camming crank 107 at this time maintains pin 99 pressed inwardly to disengage fully the drive through torque limiter 34. Thus, during the below-described filling operation, and further because of the operation of pawl wedge 105, there is no spinning of elements 27–30 during such refilling.

DESCRIPTION OF MEANS FOR SUPPLYING ADHESIVE TO THE JOINT EITHER INDIRECTLY OR DIRECTLY, AND OF THE MEANS FOR PERMITTING EASY ACCESS TO THE CUTTING BLADE FOR ELIMINATION OF JAMS

As shown in FIGS. 3, 5 and 10, head body 23 has a transverse end face 116 around passage 114. Such face is located in the vicinity of the knife blade 44 which cuts tape 18. Accordingly, when there is no nozzle attached at face 116, it is a simple matter to reach the tape passage 46 (FIG. 7) at knife blade 44 and thus eliminate jams caused by premature operation of the knife. As described above, a tape jam is often caused when an operator effects shifting of the knife prior to cessation of feeding movement of the tape, so that the tape bunches up against the knife and renders the tool inoperative until the jam is eliminated.

At all times during operation of the present tool to apply tape to a wall, except during the unjamming operation described above, there is mounted in abutting relationship to end face 116 the inner end of a "standard" nozzle 117. Nozzle 117 has a passage 118 therethrough and which corresponds in cross-sectional shape to slot 112 and the associated passages 113–114.

Nozzle 117 also has a planar end face 120 which lies in a plane parallel to that of the tape 18 when the tape is being fed through frame means 66 and through the tape passage 46 adjacent the knife mechanism. Furthermore, as shown (for example) in FIG. 5, the end face 120 is directly opposite but spaced slightly from the peripheral regions of roller elements 27, 28.

Thus, as soon as the tape is fed forwardly past the knife mechanism, to the vicinity of the rollers, it is coated on its interior surface with adhesive emanating from passage 118. This adhesive-coated surface immediately engages the wallboard opposite elements 27, 28. The adhesive is thus applied indirectly (by means of the tape) to the wallboard.

It is to be understood that, due to the above-described operation of the feeding needle 69 and associated parts, in response to shifting of sleeve 55, the tape is fed to the vicinity of the rollers in the absence of any rotation of traction wheels 29. This occurs after each cutoff operation. Then, when the tape is disposed between the rollers and the wallboard (being also between the protruding, toothed, edge regions of traction wheels 29), the tool is rolled along the wall so that there is a feeding or drawing action whereby the tape is fed from tape roll 17. As soon as this action starts, and because of the driving relationship between the traction wheels 29 and piston 13, adhesive is coated onto the tape.

The standard nozzle 117 is quick-connected in position by means of a U-shaped mounting spring 121 (FIG. 3) the ends of which are pivoted to side plates 24. The center or base region of the spring 121 is snapped into a groove (FIG. 5) in the inclined outer face 122 of nozzle 117. When the nozzle is in mounted condition, the base of spring 121 engages two shoulder portions 119 (FIG. 3) of the side plates.

To mount the nozzle 117, spring 121 is pivoted away from shoulders 119, following which the nozzle is positioned in abutting relationship to end face 116. Then, spring 121 is pivoted forceably until it snaps into the groove in end face 122. This mounting operation is rapid and effective. The nozzle is easily demounted by introducing a screwdriver adjacent one side of the nozzle and popping the spring base out of its groove.

When the tool is to be used to post-deposit adhesive over a tape which has previously been applied to wallboard 16, the originally-applied adhesive is first allowed to dry. The standard nozzle 117 is quickly removed and replaced by a post-deposit nozzle 123 shown in FIGS. 13 an 14. Such nozzle 123 is mounted by the same spring 121, and in the same way, as described relative to nozzle 117. However, the shape of the post-deposit nozzle is completely different, as illustrated. Such nozzle has an inner wall 124 which extends substantially longitudinally of the tool and then curves around roller 27. The side walls 126 of nozzle 123 are spaced farther apart than are the traction wheels (drive rollers) 29. Furthermore, there are provided in the inner wall 124 three slots 127–129 respectively adapted to receive the two traction wheels 29 and the central flange 28.

Nozzle 123 has an end face 131 at which adhesive emanates from the nozzle passage 132. Such face is relatively adjacent, but spaced somewhat from, the surface 133 of the wallboard 16 (such wallboard then having a previouslyapplied tape 18 thereon as described above).

With the described post-deposit nozzle 123, adhesive is applied over the joint at a region closely adjacent roller 27. Because the nozzle end is so close to the roller, and because face 131 does not touch the wallboard, the presence of the nozzle does not interfere with tilting of the tool as it is manipulated to various angles while moving along the joint.

The described nozzles and relationships not only permit ready access to knife blades 14 for elimination of jams, and permit post-deposit of adhesive over previouslyapplied tape, but achieve other advantages also. For example, nozzle may be supplied with different face (end) locations, different passage sizes, etc., to thus provide different adhesive-flow rates and different thicknesses of adhesive on the tape or on the wall. All this can be effected with a valve 109 which is either fully open or fully closed, without attempting to effect some predetermined valve setting. Furthermore, there is no necessity to change diameters of the cable drum 36 (FIG. 6) in order to arrive at different rates of adhesive flow.

When the post-deposit nozzle 123 is used, the tape roll 17 and tape 18 are not employed by are instead left out of the tool. The operation of the elements 27–29, 34, 99, 107, 109, etc., are the same as described above. A single tool is thus used for initial tape application and then (after drying) for external application of adhesive. Much money and storage space are thus saved, especially by relatively small operators who cannot well afford special additional tools.

FILLING AND CLEANING OF THE TOOL

Referring next to FIG. 15, there is shown a conventional fill pump 135 which, in response to pumping of handle 136, causes adhesive to flow through an upwardly directed nozzle 137 from a suitable reservoir. Thus, to fill the tool, the head end 12 thereof is caused to be in a lower position and a nozzle element 138 (shaped to mate with a frustoconical interior surface of nozzle 137) is disposed in engagement with the nozzle 137.

Upon pumping of handle 136, adhesive enters through the nozzles 137, 138, and also through a check valve 139 (FIG. 5), into the reservoir chamber 11. Filling then continues until the piston 13 is pushed (by the adhesive) back to the end of its stroke, that is to say until the cable 37 is fully unwound or else the end stop 14 (right end of FIG. 1) is engaged. During the described filling operation, the valve 109 is in fully closed position (90° away from the position shown in FIG. 5).

At the conclusion of a day's taping operation, the walls of chamber 11, the walls of the various passages, the valves, etc., are coated with adhesive residue. Referring next to FIG. 16, there is illustrated an embodiment wherein a hose connector 141 is mounted coaxially around nozzle 138*a*.

More specifically, hose connector 141 is an internally-threaded female hose fitting mounted slidably on element 138*a* and adapted to slide to a retracted position so as not to prevent normal operation of the cooperating elements 137, 138*a*.

Element 138*a* is identical to element 138, and has the same check valve therein, except that a flange is provided integrally on element 138*a* to prevent the hose fitting from being pulled completely off. Suitable seal means, not shown, are provided.

At the end of the day, and when the chamber 11 is empty, a water hose is screwed to hose connector 141 and the water is turned on. The water then flows through nozzle 138*a*, check valve 139, and the then-open valve 109. This thoroughly cleans the machine so that it is ready for the next day's operation.

SUMMARY OF OPERATION

At the beginning of the working day, the operator places the tool in vertical position with head 12 pointed downwardly, causes the nozzles 137, 138 to mate, and pumps the handle 136 of fill pump 135 (FIG. 15). Prior to such pumping, the camming crank 107 (FIGS. 2 and 9) has been rotated to such position that valve 109 is closed. Thus, the adhesive flowing into chamber 11 may not escape through the nozzle 117 to the vicinity of the rollers. As indicated above, the inflowing adhesive forces piston 13 upwardly, causing cable drum 36 (FIGS. 5 and 6) to rotate but without, however, effecting any rotation of the traction wheels 29 or roller 27 (FIG. 2).

Such rotation of the traction wheels and the roller, during filling, is prevented by the pawl wedge 105 (FIGS. 5, 8 and 12), and by the fact that the cam crank 107 is then holding the end of pin 99 inwardly. Therefore, as best shown in FIGS. 6 and 11, cross pin 100 is out of engagement with the walls of recesses 102 and cannot effect any driving of the hub 96, the sprocket 33 or the associated chain 32 and sprocket 31. Stated otherwise, the drum 36, shaft 38, pin 99 and cross pin 100 spin, but the hub 96, sprocket 33, etc., remain stationary.

After the tool is full, it is merely necessary for the operator to rotate cam crank 107 back to a position at which it is spaced from actuating pin 99 (so that spring 103 then forces cross pin 100 into recesses 102). There is then a driving relationship between the traction wheels 29 and the cable drum, by means of the torque limiter 34. The drive is as follows: Wheels or rollers 29, shaft 26, sprocket 31, chain 32, sprocket 33, balls 88, hub 96, pin 100 (which is always disposed in slot 101 and thus drives shaft end 97), shaft 38 and drum 36.

Such rotation of the cam crank also effects rotation of valve 109 to the fully open position shown at the left in FIG. 5. Then, or previously, a roll 17 (FIG. 1) of joint tape is mounted in the tape guard 19, and the end of the tape is threaded beneath frame means 66 (FIG. 2) and through tape passage 46 adjacent the cutoff mechanism (FIG. 7).

By shifting sleeve 55 toward head 12, the above-described feeding mechanism including needle 69 (FIGS. 2 and 10) is operated so as to shift the tape into the vicinity of roller 37. The end of the tape is then pressed between flange 28 and a joint region of wallboard 16. Furthermore, the tool end is moved along such a joint in a "forward direction". Such forward direction is downwardly as viewed, for example, in FIG. 5.

The traction wheels 29 then bite into the wallboard and rotate, simultaneously with feeding of the tape from the tape roll 17. Rotation of the traction wheels drives cable drum 36, as stated, causing winding of cable 37 on the drum to thus shift piston 13 toward the head 12 and effect flow of adhesive to nozzle 117. The tape passing adjacent the nozzle 117 is thus coated with adhesive and immediately transported to the wall so that the adhesive secures the tape to the wall over the joint.

As soon as piston 13 reaches the end of its stroke, it engages the inner end of head body 23. At this time, torque limiter 34 operates to permit cable drum 36 to remain stationary despite the continued rotation of traction wheels 29 and associated parts. Furthermore, the torque limiter creates a highly audible clicking sound because the balls 88 (FIG. 6) pop in and out of the associated recesses 88 as they are spring-pressed by the belleville springs 91.

This clicking sound immediately informs the operator that the adhesive flow has stopped, so that he immediately ceases taping and effects a refilling operation. Then, the tool is again placed in its vertical position with the head lowermost, and one finger of the operator is engaged with ear 107*a* on camming crank 107 (FIG. 2) to shift the camming crank to the position at which it depresses pin 99 and also closes valve 109 fully. The above-described filling operation is then again effected.

A new taping operation is then started and, if the joint is in a corner, the lever 84 (FIG. 1) is pivoted to pull on cable 82 and thus shift corner roller 77 into operative position.

At the end of each taping operation, the tape is cut off by the knife mechanism described relative to FIGS. 7 and 10, by pulling on actuating sleeve 55 to separate steeel plate 61 from permanent magnet 72 and also to pull on cable 48. This causes the knife blade 44 to traverse the tape portion in tape passage 46, thereby cutting the tape.

When there is jamming in this tape passage adjacent the knife blade, caused by premature operation of the knife prior to cessation of tape feed, the nozzle 117 is quickly removed by snapping the spring 121 (FIG. 3) out of its groove. It is then a simple matter to have access to the tape to eliminate the jammed condition. The nozzle 117 is then rapidly put back in position and the spring 121 snapped into place, following which taping recommences.

Figure 14:
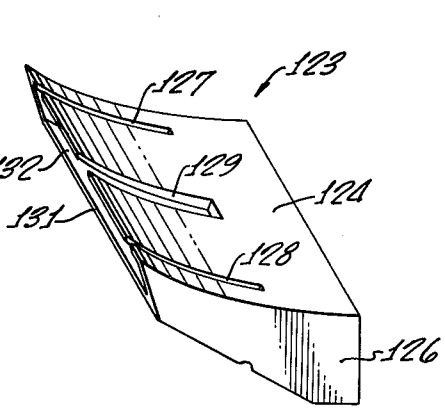
FIGS. 13 and 14 are, respectively, sectional and isometric views of the post-deposit nozzle system.
Figure 13:
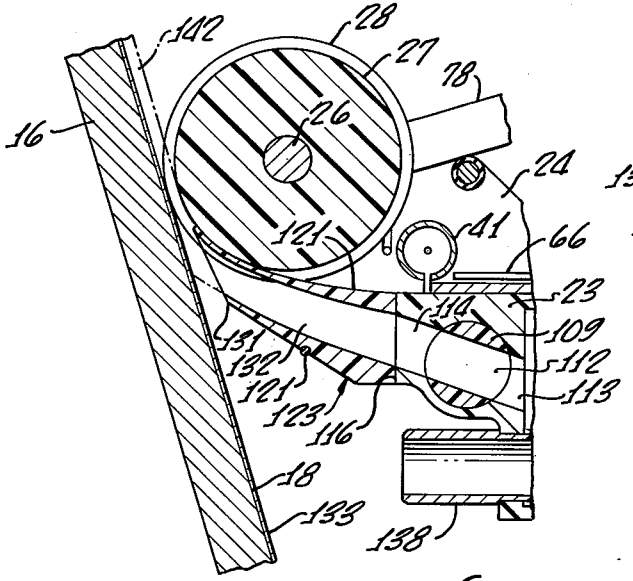

After the tape dries on various joints, and it is desired to place adhesive thereover, the standard nozzle 117 (FIG. 3) is removed by releasing the spring 121 as stated, and the post-deposit nozzle 123 shown in FIGS. 13, 14 is mounted in position in its place. The tape is then removed from the machine, following which the roller 27 is rolled along the joing over the previously-deposited tape, at which time the adhesive flows through the passage 132 (FIG. 13) and onto the tape at surface 133 of wallboard 16. The deposited adhesive is shown at 142 in FIG. 13.

The adhesive thus freshly deposited over the tape is then worked to cause it to blend into the wall. The result is a very smooth finished joint with a minimum of effort and a minimum of tools, but with a maximum of speed.

It is a major advantage of the present tool that it is relatively impervious to the effects of denting of barrel 10 as the result of being dropped or banged against an obstacle. In order that the tool will be light in weight, barrel 10 is made of thin-walled aluminum and thus does not resist denting as would (for example) steel.

When the above-described prior-art tool is dented, and the operator continues to use it, cable breakage is highly likely since the piston jams at the dent. With the present tool, however, such jamming does not result in cable breakage because the torque limiter prevents it. There being no cable breakage, the operator may repair the tool by forcing a precision-sized ball (supplied by the manufacturer) through the barrel.

The foregoing detailed description is to be clearly understood as given by way of illustration and example only, the spirit and scope of this invention being limited solely by the appended claims.

We claim:

1. A tool for supplying adhesive at a predetermined rate determined by the rate of traverse of the tool along an element of a building under construction, said tool comprising:

(a) means to define a reservoir chamber adapted to contain adhesive, (b) means to effect progressive expelling of adhesive from said chamber for application to an element of a building under construction, (c) drive means adapted to engage said building element for driving in response to traverse of the tool therealong, (d) means to connect said drive means to said adhesive-expelling means to thus effect expelling of adhesive from said chamber at a rate determined by the rate of traverse of said tool, and (e) force-limiting means interposed in said connector means to prevent more than a predetermined amount of force from being transmitted from said drive means to said adhesive-expelling means, said force-limiting means being so constructed as to transmit to said adhesive-expelling means sufficient force to effect said expelling of adhesive when there is adequate adhesive in said chamber, said force-limiting means also being so constructed as to transmit insufficient force to damage any part of said connector means in response to continued movement of the tool after said chamber is substantially empty.

2. The invention as claimed in claim 1, in which said tool is adapted to apply joint tape over a joint between two adjacent sections of wallboard, and in which means are provided to direct adhesive from said chamber onto the inner surface of said tape immediately prior to application of said tape onto said wallboard, whereby said adhesive is applied to said wallboard.

3. The invention as claimed in claim 1, in which means are provided to effect disconnection of said connector means to such extent that only substantially zero force may be transmitted from said adhesive-expelling means to said drive means during filling of said chamber.

4. The invention as claimed in claim 1, in which said force-limiting means is also a noisemaker means and makes a substantial noise readily audible by the operator when said drive means continues to operate but ceases to cause movement of said adhesive-expelling means.

5. A tool for use in the formation of joints between adjacent sections of wallboard, said joints comprising joint tape having adhesive on at least one surface thereof, said tool comprising:

(a) an elongated hollow barrel adapted to contain a mass of adhesive, (b) head means provided at one end of said barrel to direct adhesive therefrom to a predetermined location, (c) a piston mounted in said barrel remote from said head means and adapted to shift toward said head means to thus expel adhesive from said chamber through an outlet opening, (d) cable and drum means including a rotatable drum and also including a cable connected to said piston and wound on said drum, (e) drive roller means mounted rotatably on said head means and adapted to roll along the wallboard, in response to movement of the tool, whereby said drive roller means is driven, and (f) means, including torque-limiting means, to connect said drive roller means to said drum for driving of said drum to wind said cable thereon and thus shift said piston to achieve metered discharge of said adhesive, said torque-limiting means being capable of transmitting from said drive roller means to said drum sufficient torque to shift said piston and thus expel adhesive, said torque-limiting means being incapable of transmitting from said drive roller means to said drum sufficient torque to break said cable after said piston has reached the top of its stroke or has jammed, whereby it is assured that said cable will not be broken.

6. The invention as claimed in claim 5, in which said torque-limiting means is so constructed as to make a readily audible sound as soon as it commences to cease effecting rotation of said drum despite continued rotation of said drive roller means, whereby the operator is apprised that said piston has reached the top of its stroke and that adhesive flow has accordingly stopped.

7. The invention as claimed in claim 5, in which means are provided to house said torque-limiting means to thus assure that adhesive may not cause fouling thereof.

8. The invention as claimed in claim 5, in which manually-operable means are provided to substantially completely disengage the drive from said drive roller means to said drum, whereby to prevent spinning of said drive roller means during filling of said barrel with adhesive.

9. The invention as claimed in claim 8, in which valve means are provided to prevent discharge of adhesive from said barrel through said outlet opening during filling of said barrel, in which manually-operable actuator means are provided to operate said valve means, and in which said actuator means automatically effects said disengagement of said drive in response to shifting of said actuator means from a position at which said valve means is open to a position at which said valve means is closed.

10. The invention as claimed in claim 8, in which means are provided to prevent reverse rotation of said drive roller means.

11. A tool for the application of adhesive over joints between wallboard sections, said tool comprising:

(a) wall means to define a reservoir chamber, (b) outlet means through which adhesive may discharge from said chamber, (c) valve means to prevent said discharge of adhesive during filling of said chamber, (d) drive roller means adapted to roll along the wallboard when the tool is shifted longitudinally of the wallboard joint, (e) movable means associated with aid reservoir chamber to progressively expel adhesive therefrom through said outlet means when said valve means is in open condition, (f) means to connect said drive roller means to said movable means whereby the latter is driven, and (g) combination force-limiting and drive-disengaging means interposed in said connecting means (f) for limiting the transmitted force during said shifting of the tool along the joint, and for reducing the transmitted force to substantially zero during said filling of said chamber, said means comprising a force limiter adapted to transmit a force which is sufficiently great to effect said expulsion of adhesive but is insufficiently great to damage said connecting means when said movable means reaches the end of its stroke, said means further comprising means to disengage the drive from said drive roller means to said movable means so that said drive roller means will not spin and throw adhesive during said filling of said chamber.

12. The invention as claimed in claim 11, in which said actuating means are provided to effect movement of said disengaging means to a drive-disengaging position upon shifting of said valve means to closed condition, and to effect movement of said disengaging means to a drive-engaging position upon shifting of said valve means to open condition.

13. The invention as claimed in claim 12, in which said actuating means includes a crank adapted to rotate said valve when said crank is engaged and turned by the operator, said crank having a cam portion which rides over and shifts an operating element for said disengaging means when said valve is turned by said crank to closed position.

14. The invention as claimed in claim 11, in which a housing is provided to enclose substantially all portions of said combination means (g), thereby preventing fouling thereof with adhesive.

15. The invention as claimed in claim 11, in which said drive roller means is toothed, and in which pawl means are provided in association with the teeth of said drive roller means to prevent reverse rotation thereof.

16. A tool for applying joint tape and adhesive to joint regions between adjacent sections of wallboard, said tool comprising:

(a) an elongated barrel adapted to contain a charge of adhesive, (b) a head body mounted at one end of said barrel, (c) a piston movably mounted in said barrel remote from said head body, (d) drive roller means mounted adjacent said head body and adapted to roll along the wallboard for driving thereby, (e) means to connect said drive roller means to said piston to cause said piston to move toward said head body, (f) passage means provided in said head body and communicating with the interior of said barrel whereby adhesive may flow through said passage means in response to said piston movement, (g) means to pass joint tape adjacent said head body and thence to said drive roller means, (h) means, including a movable knife element, to effect cutting-off of said tape, said cutting means being disposed in the vicinity of that end of said passage means which is remote from said barrel, (i) a nozzle having a passage therethrough, and (j) means to removably mount said nozzle on said head body with the inner end of said nozzle passage communicating with said end of said passage means, said nozzle being so disposed when in mounted position on said head body, so as to obstruct access to said cutting means, said means (g), said head body and said cutting means being so related that when said nozzle is removed the operator may have easy access to said cutting means for elimination of tape jams thereat.

17. The invention as claimed in claim 16, in which said tool further comprises a second nozzle having characteristics different from those of said first-mentioned nozzle, and which is adapted to be mounted on said head body in place of said first-mentioned nozzle.

18. The invention as claimed in claim 17, in which said first-mentioned nozzle is shaped to discharge adhesive onto the inner surface of said tape as said tape passes therepast, and in which said second nozzle is shaped to discharge adhesive directly onto the wallboard, whereby said first-mentioned nozzle may be used in the initial application of tape, and said second nozzle may be used to apply adhesive over previously-laid tape.

19. The invention as claimed in claim 18, in which said second nozzle is shaped to discharge adhesive immediately adjacent said drive roller means, so that the tool may be tilted to various angles while continuing to operate.

20. The invention as claimed in claim 16, in which said mounting means is so constructed that said nozzle may be mounted and demounted rapidly.

21. A tool for applying joint tape to wallboard, which comprises:

(a) an elongated barrel adapted to contain a charge of adhesive, (b) a head mounted at one end of said barrel, said head including a head body in which is formed a cavity for a rotatable valve element, (c) a rotatable valve element mounted in said cavity, said valve element having passage means therethrough adapted to conduct adhesive out of said barrel when, and only when, said valve element is in a predetermined range of rotated positions, (d) a cable drum rotatably mounted in said head body and being connected by a cable to a piston in said barrel, (e) drive roller means provided on said head and being adapted to engage and be driven by the walboard as said head is manually traversed therealong, (f) means to drivingly connect said drive roller means to said drum for operation thereof, (g) means to effect disengagement of said connector means, (h) means, responsive to rotation of said valve element to a position blocking flow of said adhesive, to operate said disengaging means (g) to a position disengaging the drive from said drive roller means to said cable drum, and (i) means to inject adhesive into said barrel for refilling thereof, said means (h) cooperating with said valve element (c) to prevent throwing and spillage of adhesive during said refilling, in that said drive roller means is disengaged from said cable drum, and in that said valve element prevents leakage out of said barrel.

22. The invention as claimed in claim 21, in which means are provided on said barrel to mount a roll of joint tape and to guide the free end of said roll to said drive roller means, in which a remotely-operated cutoff mechanism is provided adjacent said head body to cut off said tape after the end of a joint is reached, and in which a nozzle is removably secured to said head body in communication with aid valve cavity, said nozzle when removed causing said cutoff mechanism to be exposed for elimination of tape jams thereat.

23. The invention as claimed in claim 21, in which a water clean-out means is provided in combination with said injection means (i), and includes a female hose coupling for connection to a water hose.

24. A tool for application of adhesive to wallboard, which comprises:

(a) wall means to define an elongated chamber for adhesive, (b) a piston provided in said chamber, (c) drive roller means adapted to engage the wallboard for driving thereby, said drive roller means being connected to said piston for shifting thereof as the tool is traversed along the wallboard, (d) means to direct the outflow of adhesive discharged from said chamber as the result of said shifting of said piston, (e) valve means to block flow of adhesive from said chamber to said director means, (f) port means provided in said wall means to permit injection of adhesive into said chamber, said port means having a check valve associated therewith and permitting ingress of adhesive through said port means but preventing egress of adhesive therethrough, and (g) hose connector means provided at said port means for connection to a water hose, whereby cleaning water may be passed inwardly through said port means and check valve and then flows outwardly through said valve means and director means.

25. The combination with an adhesive applicator tool for use in covering the joint regions between adjacent sections of wallboard, said tool including an elongated barrel for holding adhesive and which also contains a piston adapted to force said adhesive out of said barrel, said tool further including drive roller means disposed to roll along the wallboard and adapted to be connected to a cable drum on which is wound a cable connected to said piston, of an improvement which comprises:

(a) driving connection means between said drive roller means and said cable drum and which includes a device to transmit therethrough torque sufficient to cause said drum to turn in response to rotation of said drive roller means when there is adequate adhesive in said barrel, but insufficient to cause said drum to turn when said piston has reached the end of its stroke, and (b) means adapted to disengage the driving connection through said device when said barrel is being recharged with adhesive, so that said drive roller means will not then spin and throw adhesive in response to movement of said piston caused by injection of adhesive.

26. The inventin as claimed in claim 25, in which said device comprises a movable element which is spring-pressed into an opening in an adjacent element, and which is shaped to pop out of said opening when the torque becomes excessive, movements of said movable element relative to said opening creating distinctly audible sounds which act as signals.

27. The invention as claimed in claim 25, in which valve means are provided to block flow of adhesive out of said barrel, and in which means are associated with said valve means to shift said means (b) to disengaging position when said valve means is shifted to closed position.

28. The invention as claimed in claim 25, in which said means (a) and (b) comprise a hollow shaft mounted coaxially of said drum for rotation therewith, said hollow shaft having slot means at one end adapted at all times to contain a cross pin, an actuating pin movably mounted coaxially of said hollow shaft and connected at one end to said cross pin, a hub mounted rotatably on said hollow shaft and including recess means adapted to receive said cross pin, a toothed wheel mounted rotatably on said hollow shaft and including recesses which partially receive balls, said balls being disposed in holes in said hub, and in which spring means are provided to push against aid balls with predetermined force and force the same into said sprocket recesses.

29. The invention as claimed in claim 28, in which said spring means are belleville springs.

30. The invention as claimed in claim 28, in which additional spring means are provided to bear against said one end of said actuating pin and force said cross pin into said hub recess means.

31. The invention as claimed in claim 30, in which valve means are provided to block flow of adhesive out of said barrel, and in which a cam crank is provided on said valve means to permit manual operation thereof and to cam against the other end of said actuating pin to shift said cross pin out of said hub recess means, thus interrupting the drive.

32. The invention as claimed in claim 28, in which a housing is mounted on said toothed wheel and extends around said hub, balls, cross pin spring means, and associated ends of said hollow shaft and of said actuating pin.

33. The invention as claimed in claim 25, in which said means (a) and (b) include a toothed element rotatably mounted on the shaft for said cable drum, said toothed element being drivingly associated with said drive roller means, in which a housing is mounted on said toothed element for rotation therewith, and in which there are enclosed and protected in said housing both a torque limiter which will transmit only a predetermined range of substantial torques from said toothed element to said shaft and thus to said drum, and also a means to disengage said torque limiter for prevention of free wheeling of said drive roller means when said barrel is refilled.

34. The invention as claimed in claim 33, in which said torque limiter comprises spring-pressed elements forced into recess means, and adapted to shift out of said recess means when the torque becomes excessive.

35. The combination of an adhesive applicator tool for use in covering the joint regions between adjacent sections of wallboard, said tool including an elongated barrel for holding adhesive and which also contains a piston adapted to force said adhesive out of said barrel, said tool further including drive roller means disposed to roll along the wallboard and adapted to be connected to a cable drum on which is wound a cable connected to said piston, of an improvement which comprises means to create a driving connection between said drive roller means and said cable drum and which includes a device adapted to transmit therethrough torque sufficient to cause said drum to turn in response to rotation of said drive roller means when there is adequate adhesive in said barrel, but insufficient to cause said drum to turn when said piston has reached the end of its stroke or has jammed.

36. The invention as claimed in claim 35, in which said device is a toothed element mounted rotatably on the shaft for said cable drum, said toothed element being drivingly connected with said drive roller means, in which a housing is mounted on said toothed element for rotation therewith, and in which limiting means are provided in said housing to transmit from said toothed element to said drum shaft torque sufficient to effect turning of said drum when there is adequate adhesive in said barrel, but insufficient to effect said turning when said piston is at its stroke end or has jammed.

37. The invention as claimed in claim 35, which said device is constructed to make a highly audible noise when said toothed element continues turning after said piston reaches its stroke end.

38. The invention as claimed in claim 35, in which said driving connection means comprises a shaft mounted coaxially of said drum for rotation therewith, a hub mounted rotatably on said shaft and drivingly associated with said shaft, a toothed wheel mounted rotatably on said shaft and including recesses which partially receive rounded elements, said rounded elements being disposed in openings in said hub, and in which spring means are provided to push against said rounded elements with predetermined force and force the same into said toothed wheel recesses.

39. A tool for supplying adhesive at a predetermined rate determined by the rate of traverse of the tool along an element of a building under construction, said tool comprising:

(a) means to define a reservoir chamber adapted to contain adhesive, (b) means to effect progressive expelling of adhesive from said chamber for application to an element of a building under construction, (c) drive means adapted to engage said building element for driving in response to traverse of the tool therealong, (d) means to connect said drive means to said adhesive-expelling means to thus effect expelling of adhesive from said chamber at a rate determined by the rate of traverse of said tool, and (e) means to at least partially disengage the drive from said drive means to said adhesive-expelling means when said chamber is substantially empty, and to make a distinctly audible signal noise informing the operator of said empty condition, said signal noise continuing while said tool is traversed along the building element with said drive means engaged therewith.

* * * * *

UNITED STATES PATENT AND TRADEMARK OFFICE

CERTIFICATE OF CORRECTION

PATENT NO. : 4,090,914

DATED : May 23, 1978

INVENTOR(S) : Thomas D. Hauk and Masato Howard Konishi

It is certified that error appears in the above-identified patent and that said Letters Patent are hereby corrected as shown below:

IN THE ABSTRACT: Line 13, cancel "spacing."

Column 1, line 21, after "wheels" cancel the hyphen (-) and substitute a dash (—).

Column 3, line 65, cancel "to" (first occurrence) and substitute --- so ---.

Column 4, line 19, after "standard" insert --- quick ---.

Column 5, line 11, after "shaft" cancel the comma (,); line 26, cancel "a" and substitute --- as ---.

Column 6, line 30, cancel "bail" and substitute --- ball ---; line 49, cancel "adjustbly" and substitute --- adjustably ---.

Column 7, line 61, after "strip" cancel the hyphen (-) and substitute a dash (—).

Column 8, line 55, cancel "it" and substitute --- is ---.

Column 11, line 66, cancel "an" and substitute --- and ---.

Column 12, line 13, after "previously" and before "applied" insert a hyphen (-); line 26, cancel "nozzle" and substitute --- nozzles ---; line 37, cancel "by" and substitute --- but ---.

Column 14, line 37, cancel "steeel" and substitute --- steel ---.

Column 18, line 14, cancel "so."

Column 19, line 18, cancel "aid" and substitute --- said ---.

Column 20, line 7, cancel "inventin" and substitute --- invention ---; line 32, cancel "aid" and substitute --said--.

UNITED STATES PATENT AND TRADEMARK OFFICE

CERTIFICATE OF CORRECTION

PATENT NO. : 4,090,914

DATED : May 23, 1978

INVENTOR(S) : Thomas D. Hauk and Masato Howard Konishi

It is certified that error appears in the above-identified patent and that said Letters Patent are hereby corrected as shown below:

Column 21, line 29, before "which" insert --- in ---.

Signed and Sealed this

*Twentieth* Day of *November 1979*

[SEAL]

*Attest:*

RUTH C. MASON
*Attesting Officer*

LUTRELLE F. PARKER
*Acting Commissioner of Patents and Trademarks*